US005333423A

United States Patent [19]

Propst

[11] Patent Number: 5,333,423

[45] Date of Patent: Aug. 2, 1994

[54] FLOOR SYSTEM

[76] Inventor: Robert L. Propst, 18845 NE. 49th Pl., Redmond, Wash. 98052

[21] Appl. No.: 995,720

[22] Filed: Dec. 23, 1992

[51] Int. Cl.[5] ..... E04B 5/00

[52] U.S. Cl. ..... 52/126.6; 52/263; 52/508; 52/509; 52/782; 52/403.1; 248/188; 248/188.9

[58] Field of Search ..... 52/126.5, 126.6, 126.7, 52/508, 509, 220.2, 220.5, 468, 467, 471, 263, 479, 480, 481; 52/782, 403; 248/188, 188.4, 188.9, 157; 403/257, 258

[56] References Cited

U.S. PATENT DOCUMENTS 3,318,057 5/1967 Norsworthy ..... 52/480

4,015,808 4/1977 Carroll ..... 248/188.4

4,546,580 10/1985 Ueno et al. ..... 52/126.5

FOREIGN PATENT DOCUMENTS 1432075 4/1976 United Kingdom ..... 52/126.6

*Primary Examiner*—Michael Safavi

*Attorney, Agent, or Firm*—Seed and Berry

[57] ABSTRACT

A floor system has removable floor panels resting at their corners on support rings provided by vertically adjustable pedestal units. The upper ends of the pedestal units have hex-heads for receiving a height adjusting tool. Access to the hex-heads is obtained by removing cornercaps held in place by screws threaded into the hex-heads. The support rings do not turn while the pedestal units are being adjusted in height.

18 Claims, 3 Drawing Sheets

FLOOR SYSTEM

TECHNICAL FIELD

The present invention relates to floor systems of the type having removable floor panels supported by pedestals located in a subfloor plenum area.

BACKGROUND OF THE INVENTION

For versatility of construction and layout, and ease of access to utilities and ducts, it has been proposed to run ducts, wiring and plumbing in plenum beneath a floor structure having removable floor panels resting on pedestals in a modular layout. However, to make such an arrangement practical there must be provision for easily leveling the floor and for sealing the floor panels from the subfloor plenum area.

SUMMARY OF THE INVENTION

The present invention provides an improved floor leveling and sealing system incorporating removable floor panels resting on pedestals in which the pedestals comprise screw jacks operated from the top of the pedestals. The floor panels are recessed at their corners to provide space for removable hold-down caps which cover the top of the pedestals and give access for a tool to adjust the screw jacks. The caps are clamped down against shoulders on the adjacent floor panels by screws threaded into the pedestals, and the panels are in turn seated on support rings mounted on the pedestals. Downturned lips at the recessed corner portions of the floor panel interfit with the support rings. The mounting of the support rings on the pedestals is such that the turnable screw jack component of the pedestals can be turned for adjustment within the respective support ring. Extension and retraction of a pedestal by adjustment of its screw jack components, results in raising and lowering of the respective support ring, and hence causes raising and lowering of the floor panels resting on the support ring.

The floor panels and the caps each have a peripheral sealing gasket which is compressed when the adjoining panels and caps are in position. The gaskets are located above the level of the floor panel shoulders on which the caps are seated.

DETAILED DESCRIPTION OF THE INVENTION

Figure 1:
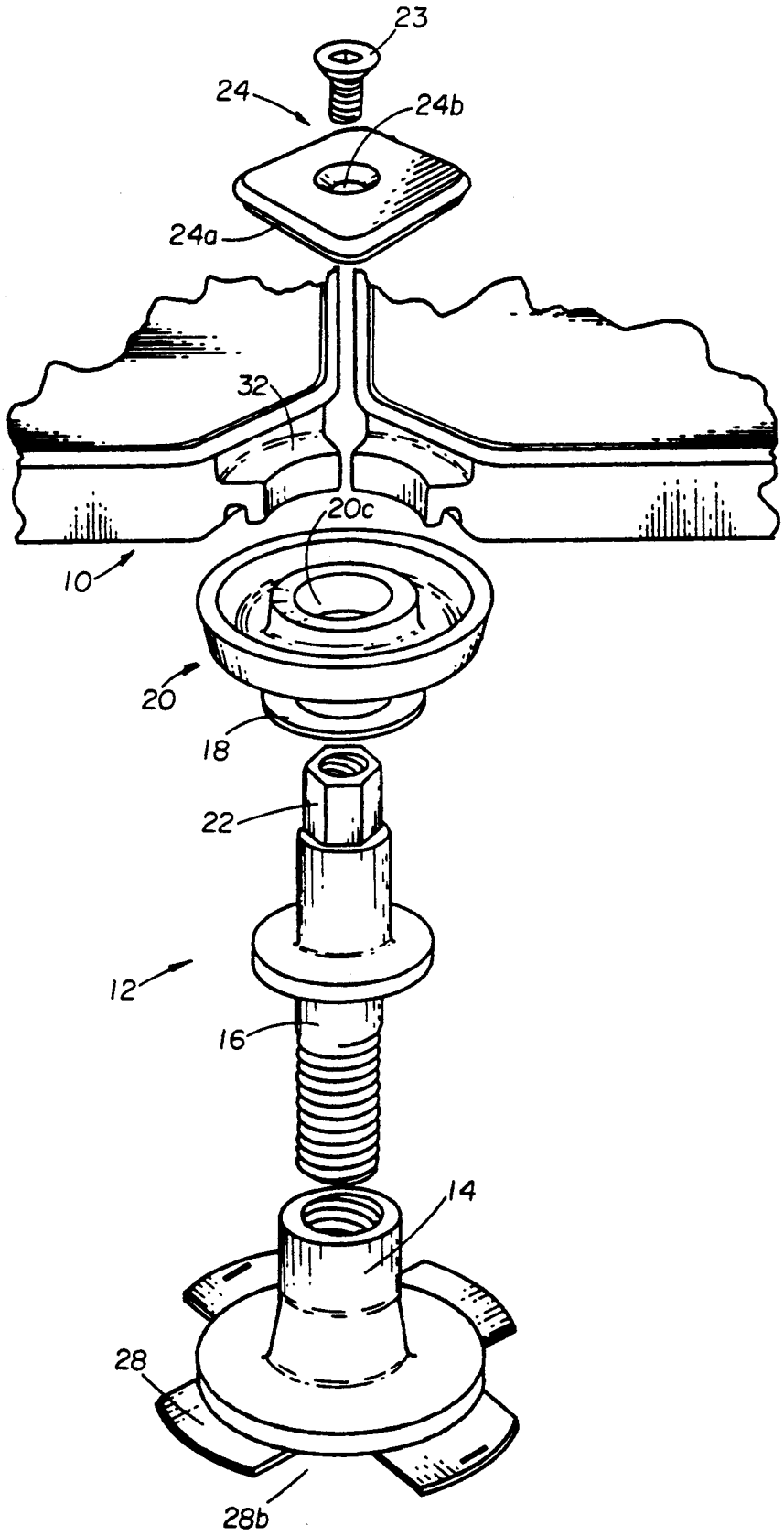
FIG. 1 is an exploded view of a pedestal unit and showing related recessed corner portions of two adjoining floor panels.
Figure 2:
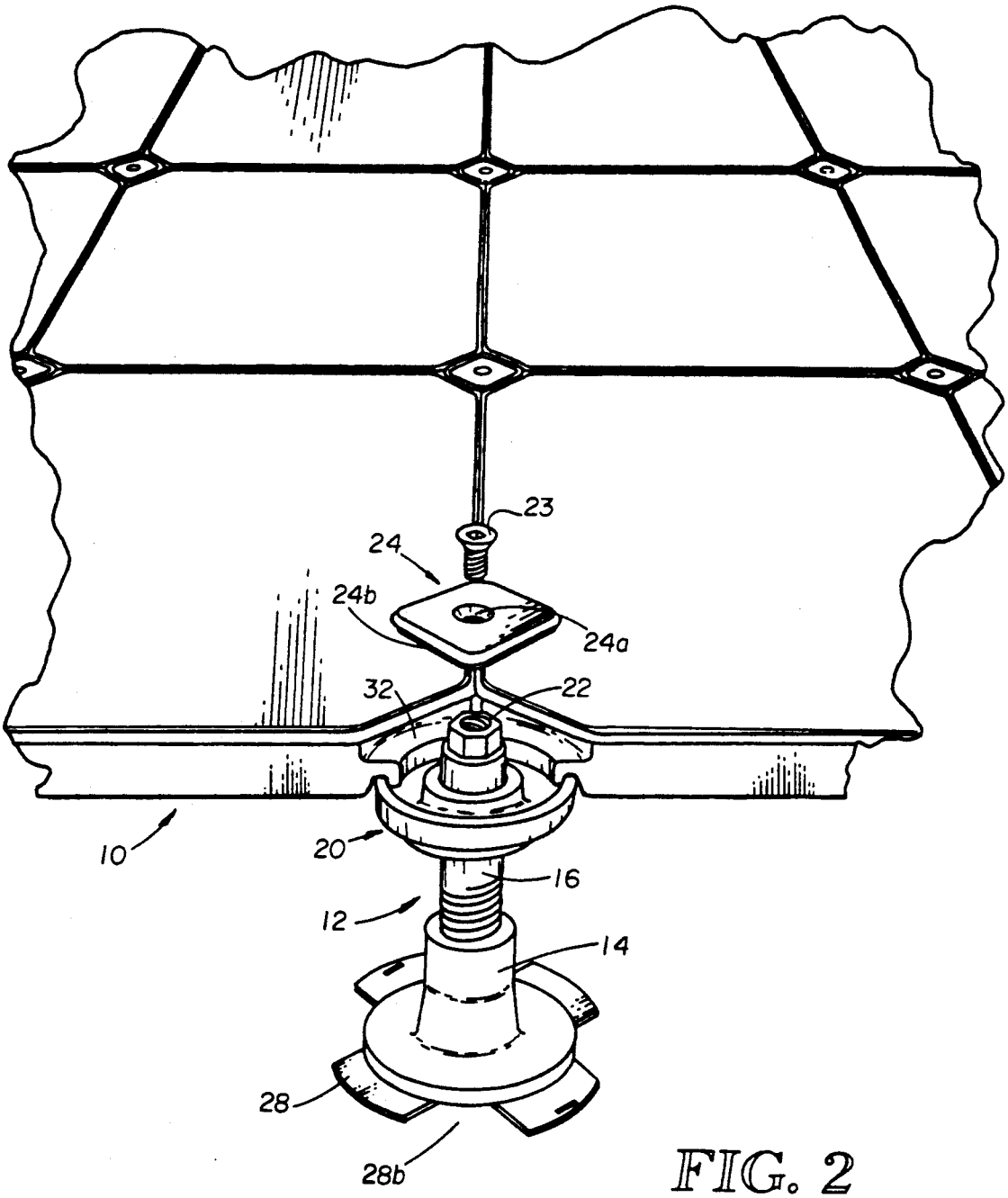
FIG. 2 is a perspective plan view of a floor section formed by the present invention and showing one of the pedestals in elevation with the respective hold-down cap and screw in exploded relation.
Figure 3:
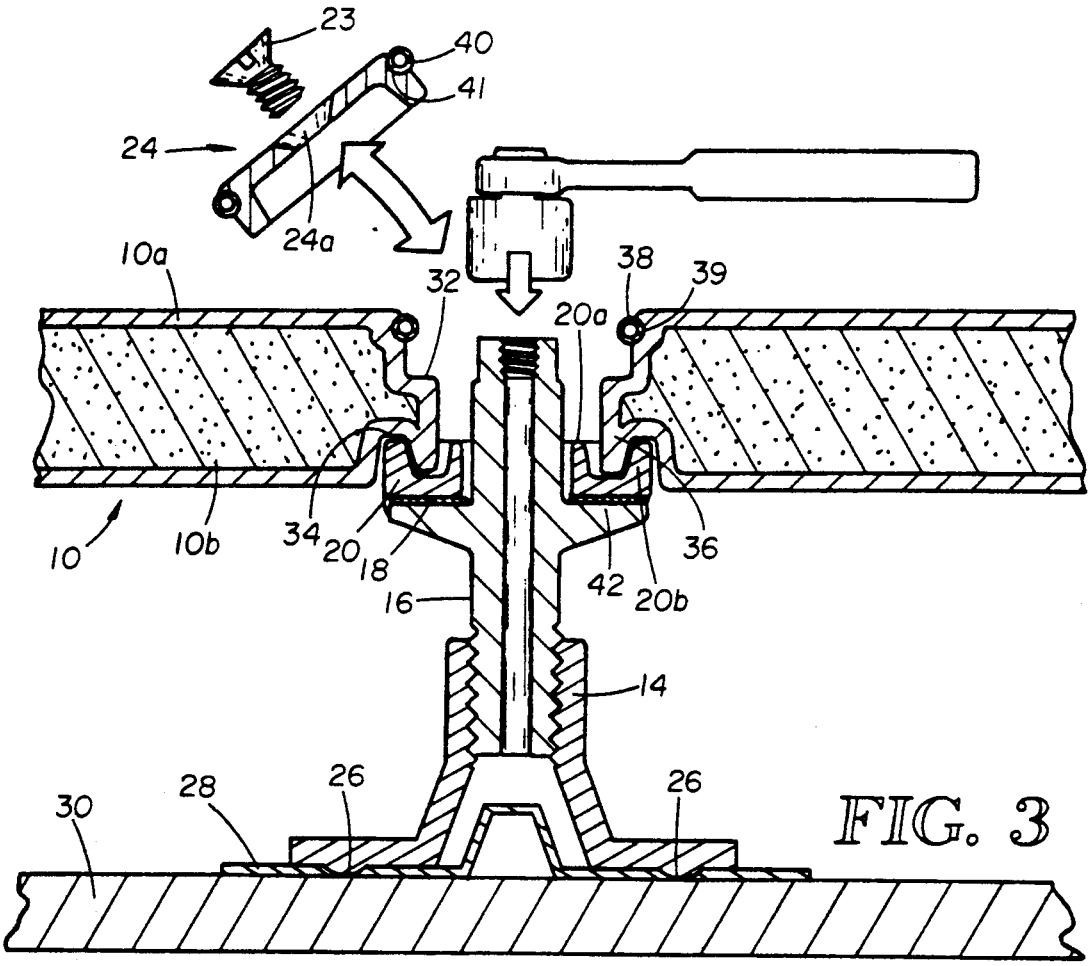
FIG. 3 is a vertical sectional view taken as indicated by line 3—3 in FIG. 2, and showing the manner of applying a wrench for extension or retraction of the respective pedestal.
Figure 4:
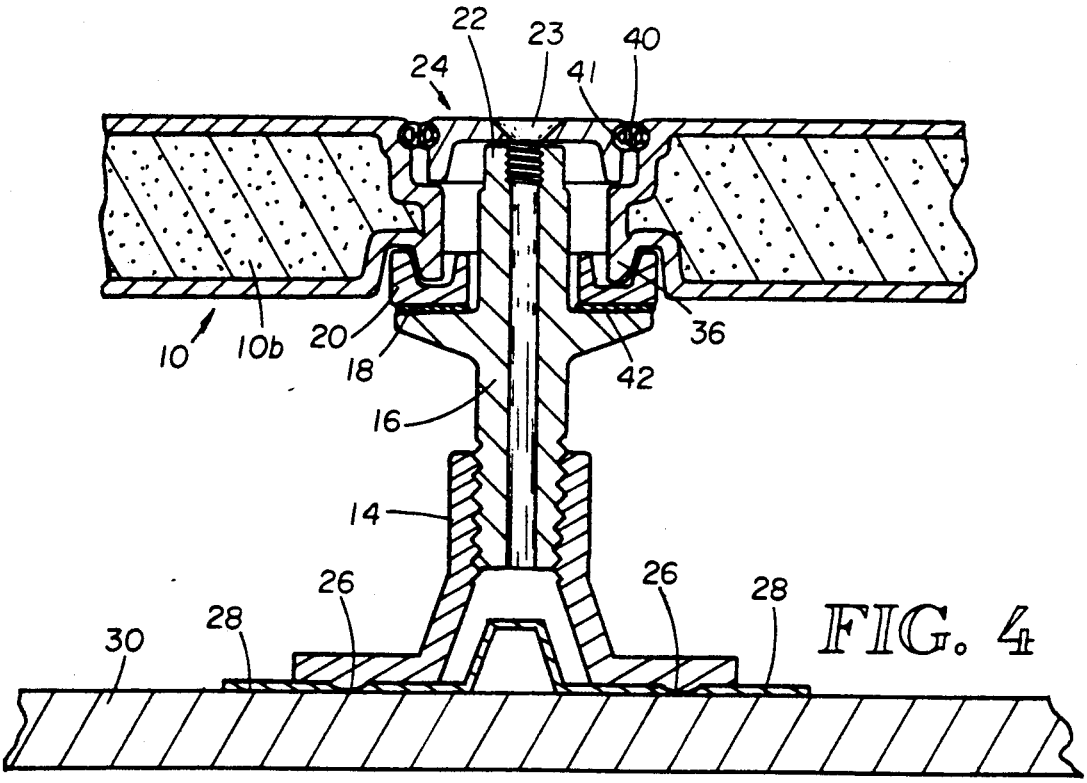
FIG. 4 corresponds to FIG. 3 after adjustment and positioning of the respective hold-down cap.

In accordance with the present invention, rectangular floor panels 10 are supported at corner portions on vertically adjustable pedestal assemblies 12, each having a base 14, column 16, bearing washer 18, and panel support ring 220. The upper end of each column 16 has an internally threaded hex-head 22 for receiving a clamping screw 23 passing through a square hold-down cap 24. At its lower end, each pedestal base 14 has support feet 26 and interfits with a respective horizontal adjustment plate 28 permitting limited horizontal movement of the base 14 on the underlying subfloor 30.

The floor panels 10 are preferably of molded plastic construction providing a durable plastic skin 10*a* enclosing a structural foam core 10*b*. The corners of the floor panels are blunted and shaped to provide a recessed cap seat 32 spaced above an annular groove 34 surrounded by an annular restraining lip 36.

Each panel has a sealing gasket 38 therearound fitting into a peripheral groove 39 in the panel located above the level of the cap seats 32. Likewise, each hold-down cap 34 also has a surrounding sealing gasket 40 fitting into a peripheral groove 41.

The lower end portion of the column 16 is externally threaded and screws into the base 14 for vertical adjustment of the effective height of the pedestal and, more specifically, the height of an annular ledge 42 on the column. This ledge 42 serves as a seat for the bearing washer 18 on which the support ring 20 is in turn seated to support the corner portions of four of the panels 10.

The support ring 20 has a circular groove 20*a* surrounded by a circular support lip 20*b* to provide a torque and groove interfitting relationship with the restraining lip 36 and groove 34 at the adjoining corner portions of four floor panels 10. In this relationship, the upper wall of the panel groove 34 seats against the top of the support tip 20*b* of the support ring 20 and the panel restraining lip 36 depends into the groove 20*a* of the support ring. Preferably, the depending lip 36 is horizontally narrower than the groove 20*a* and has substantially the same mean radius as the groove 20*a* so that there is a reasonable horizontal adjustment tolerance between the floor panels and each support ring 20. Similarly, it is preferred that the center opening 20*c* in the support ring 20 be larger than the outside diameter of the column 16 to provide additional horizontal adjustment tolerance for the floor panels relative to the pedestals 12.

The seats 32 at the adjoining corner portions of four of the floor panels collectively provide a square seat for engagement by the bottom edge of a depending peripheral lip 34*a* of a respective one of the square hold-down caps 34. The caps 34 have a tapered center hole 34*b* for receiving the clamping screws 23 which are adapted to be threaded into the hex-heads 22 on the pedestals such as to be flush with the upper surface of the caps when they are in turn flush with the upper surface of the related floor panels. This normally occurs when the bottom lip 34*a* of each cap is seated on the seats 32 at the corner portions of the related panels.

The caps 34 are of a size to provide, when removed, an opening around the hex-head 22 of the related pedestal which is large enough to provide easy application of a socket wrench to the hex-head for turning the respective column 16 relative to the related base 14 and relative to the related support ring 20. In this manner, the height of the pedestals 10 can be readily adjusted for leveling the floor panels.

Providing the support ring component 20 of each pedestal assembly 10 as a separate part permits the pedestal heights to be adjusted without turning of the support rings relative to the floor panels. Although this arrangement is advantageous and is preferred, it will be appreciated that the support rings 20 could be integrated with the columns 16.

The pedestal bases 14 may be secured to the underlying subfloor. However, it is preferred to provide for limited horizontal movement of the pedestals relative to the subfloor. For this reason, the pedestal base 14 has a tapered bottom cavity 14*a* to fit over an open-ended frusto-conical alignment post 28*a* of smaller size provided by the adjustment plates 28. Each adjustment plate is adapted to be stapled or otherwise secured to the subfloor and has four equally spaced radially extending slots 28*b* which are tapered to expand in width toward their outer ends. These slots 28*b* accommodate the pedestal feet 26 such that each pedestal is free to skid on the subfloor a limited amount defined by the clearance of the alignment posts 28*a* within the base cavities 14*a*. The side edges of the slots 28*b* limit turning of the pedestal bases 14 relative to the subfloor.

In utilizing the present floor panel system, it is preferred to mark the surface of the subfloor with an x-y grid corresponding to the size of the floor panels. Then the adjustment plates 28 are positioned and secured in place with their posts centered over the grid's intersections. The pedestal assemblies 12 are then positioned over the plates 28 following which the floor panels 10 are seated in place on the support ring components 20 of the pedestals. During this process, the pedestals can move as may be necessary relative to the subfloor. The column components 16 are then screwed relative to the base components 14 and panels 10 to level the panels. Finally, the caps 24 are applied to the pedestals and clamped down by the screws 23 to in turn clamp the panels 10 down against the support rings 20. During this clamping operation, the peripheral gaskets 38, 40 on the floor panels 10 and caps 24 are pressed together and provide a total joint seal. The gaskets 38, 40 preferably comprise vinyl or butyl tubing.

The described floor system permits the individual floor panels 10 to be easily removed for ready access to the underlying plenum by initially removing the related caps 24 after loosening the respective screws 23.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A floor system comprising:

a pedestal including a base member and a column screw-mounted on said base member for up and down movement responsive to turning of said column relative to said base member about a vertical axis, said column having a head portion adapted to receive a tool for turning said column;

coplaner horizontal panels partly supported on said column, and leaving a top access area to the top of said column such that said column can be turned by said tool for height adjustment relative to said panels and base member, the upper surface of said panels being at a level higher than the upper end of said head portion;

a removable cap overlapping portions of said panels in said access area and flush at the top with surfaces of said panels, and a hold-down screw extending through said cap into said head portion of the column.

2. A floor system according to claim 1 in which said panels and cap have cooperating peripheral sealing gaskets.

3. A floor system according to claim 1 in which said column has an annular ledge supporting a support ring with which said panels detachably interfit such as to be restrained from horizontal movement away from said ring, but free to be lifted away from said ring, said ledge being free to be turned relative to said ring during said height adjustment.

4. A floor system according to claim 3 in which a bearing is located between said support ring and annular ledge.

5. A floor system comprising:

a pedestal including a base member and a column screw-mounted on said base member for up and down movement responsive to turning of said column relative to said base member about a vertical axis, said column having a head portion adapted to receive a tool for turning said column;

coplaner horizontal panels partly supported on said column, and leaving a top access area to the top of said column such that said column can be turned by said tool for height adjustment relative to said panels and base member, the upper surface of said panels being at a level higher than the upper end of said head portion;

said base member having bottom feet for engaging a subfloor and having a bottom cavity;

and an adjustment plate for resting on the subfloor and presenting a post projecting into said cavity, said adjustment plate also having radial slots receiving said feet.

6. A floor system according to claim 5 in which said base member can be moved laterally a limited distance relative to said adjustment plate.

7. A floor system comprising:

like parallel rows of pedestals, each pedestal having panel support means adjacent its upper end, floor panels filling the space between said pedestals and each having ledge portions resting on the panel support means of four of said pedestals, the upper end of each pedestal having a central area exposed between the respective panels resting on the panel support means of the pedestal;

each pedestal having length adjustment means and having adjustment access to said length adjustment means at said central area;

removable caps covering said central areas and resting on said ledge portions, the upper surface of said caps being flush with the upper surface of said panels;

and screws detachably securing said caps to said pedestals.

8. A floor system according to claim 7 in which sealing gaskets are provided between said panels and between said caps and the panels.

9. A floor system according to claim 7 in which said floor panels interfit with said panel support means at the underside of said ledge portions such that said panels are restricted against horizontal movement away from said pedestals, but are not restricted against vertical movement or turning movement relative to said pedestals.

10. A floor system comprising:

like generally rectangular floor panels arranged in like rows forming a floor surface interrupted by square openings at regular intervals where adjacent corner portions of four of said panels meet;

square caps filling said square openings;

and respective gaskets surrounding each of said panels and said caps, said gaskets being arranged such that adjacent of said gaskets engage one another to seal between said panels and between said panels and caps.

11. A floor system according to claim 10 in which said square openings are provided by top recesses at the corners of said panels, each of said recesses having a bottom shoulder for supporting a portion of one of said caps, and each of said gaskets being above the level of said shoulders.

12. A floor system according to claim 10 in which said caps overlap portions of said floor panels bordering said square openings.

13. A floor system according to claim 12 in which said panels rest on vertically adjustable pedestals and said caps are connected to said pedestals by removable connectors.

14. A pedestal for supporting floor panels in a floor system, said pedestal comprising:

a base member;

a column screw-mounted on said base for up and down movement responsive to turning of said column relative to said base, said column having a head adapted to receive a tool for turning, said column, and having an upwardly facing annular seat; and a panel support ring sleeved on said column below said head and carried by said seat such that said column can be turned relative to said ring for height adjustment of the ring and related panels supported thereon.

15. A pedestal according to claim 14 in which said panel support ring has an upwardly facing annular groove surrounding said column for receiving downwardly facing panel lips.

16. A pedestal according to claim 14 which said head has a threaded vertical hole exposed at its upper end for receiving a hold-down screw for a cap.

17. A pedestal according to claim 14 in which a bearing is located between said panel support ring and said annular seat provided by said column.

18. A floor panel assembly comprising:

a structural panel member with upper and lower faces which is generally rectangular in shape which viewed from the top or bottom, except that the corner portions are recessed and are formed with downwardly extending locking lips which are arcuate when viewed from the bottom;

said panel member also having upwardly facing shoulders above said locking lips which are recessed below the upper face of the panel member; and a gasket completely surrounding the periphery of said panel member above the level of said upwardly facing shoulders.

* * * * *